US006618947B1

(12) United States Patent
Gardiner et al.

(10) Patent No.: US 6,618,947 B1
(45) Date of Patent: Sep. 16, 2003

(54) SPRING FOR KNIFE

(75) Inventors: Walter A. Gardiner, Waccabuc, NY (US); Dieh Stecyk, Kerhonkson, NY (US); James Quinn, Montgomery, NY (US)

(73) Assignee: Imperial Schrade Corp., Ellenville, NY (US)

( * ) Notice: Subject to any disclaimer, the term of this patent is extended or adjusted under 35 U.S.C. 154(b) by 0 days.

(21) Appl. No.: 10/218,153

(22) Filed: Aug. 12, 2002

Related U.S. Application Data

(63) Continuation of application No. 29/137,779, filed on Feb. 27, 2001, now abandoned.

(51) Int. Cl.[7] ..... B26B 3/06
(52) U.S. Cl. ..... 30/161
(58) Field of Search ..... 30/160, 161

(56) References Cited

U.S. PATENT DOCUMENTS

| | | | | |
|---|---|---|---|---|
| 2,416,277 A | | 2/1947 | Siegel | |
| 4,040,181 A | * | 8/1977 | Johnson | 30/161 |
| 4,268,960 A | | 5/1981 | Reinschreiber | |
| 4,347,665 A | | 9/1982 | Glesser | |
| 5,461,786 A | | 10/1995 | Miller | |
| 5,511,310 A | | 4/1996 | Sessions et al. | |
| 5,826,340 A | | 10/1998 | Hull | |
| 6,256,888 B1 | | 7/2001 | Shuen | |
| 6,308,420 B1 | | 10/2001 | Moser | |

* cited by examiner

*Primary Examiner*—Douglas D. Watts
(74) *Attorney, Agent, or Firm*—SAIDMAN DesignLaw Group

(57) ABSTRACT

A knife comprising a handle, a blade pivotally coupled to the handle, a lock pivotally coupled to the handle, and a spring having at least one transversely extending portion that contacts the lock. In a preferred embodiment, the spring is U-shaped and supported by recesses in the handle. Also in a preferred embodiment, the spring is coupled to the handle near the blade and extends rearward.

17 Claims, 1 Drawing Sheet

SPRING FOR KNIFE

CROSS-REFERENCE TO RELATED APPLICATION

This application is a continuation of our prior application Ser. No. 29/137,779, filed Feb. 27, 2001 now abandoned which is incorporated by reference herein in its entirety.

BACKGROUND OF THE INVENTION

1. Field of the Invention

The present invention relates to a knife, and more particularly, to a knife with an improved spring therein.

2. Description of Related Art

Pocket knives have been known for many years. One type of conventional pocket knife includes a handle, a blade, and a lock. The blade and lock are pivotally coupled to the handle. The blade moves between a closed position, where the blade is stored within the handle, and an open position, where the blade extends from the handle.

The handle includes two-side panels separated by a spacer, which forms an interior cavity between the panels for receiving the blade in the closed position. The handle components are usually held together with fasteners. The lock secures the blade in the open position so that the blade cannot accidentally move from the open position and close on a user's hand.

In order to bias the lock into secure locking contact with the blade, these knives typically include a spring. Such knives are disclosed in U.S. Pat. No. 5,511,310 entitled "Folding Knife" to Sessions et al. and U.S. Pat. No. 5,826,340 entitled "Two-Piece Handle and Method of Assembly" to Hull. In the Sessions et al. patent, the knife includes a cylindrical spring having a free end resiliently opposing the distal end of a lock bar. The spring is used to keep the handle sections assembled together so that fasteners are not necessary to assemble the handle. The Hull knife similarly has a cylindrical spring that is used to bias a lock rocker and to tightly assemble the handle sections together.

Since these springs extend down the center of the interior cavity of the knife, the blade when closed must be below the spring. This configuration increases the height of the handle and influences the packing arrangement of the components therein. In order to generate sufficient spring force, these springs must have a large diameter, which can increase the dimensions of the handle. Thus, the shape and size of knife handles in the past could not be varied greatly due to the spring configuration, dimensions, and location.

A manufacturer of consumer goods is always keen for new design ideas that help to distinguish the manufacture's product from those of others. One such idea, which has not heretofore been possible, is creating smaller, uniquely shaped knife handles. It is also desirable to form rugged springs with smooth operation.

The present invention was developed with the above-noted general objects in mind.

SUMMARY OF THE INVENTION

The invention is a knife comprising a handle, a blade pivotally coupled to the handle, a lock pivotally coupled to the handle, and a spring having at least one transversely extending portion that contacts the lock. In a preferred embodiment, the spring is U-shaped and supported by recesses in the handle.

According to one feature of the present invention, the handle further includes a first end and a second end, and the blade is coupled to the handle near the first end. In such a knife, the spring further includes supported ends near the first end of the handle. According to yet another feature of such a knife, the handle further defines a first height at the first end and a second height at the second end, the second height being less than the first height.

In one embodiment, the spring further includes a circular cross-sectional shape. According to another embodiment, the spring further includes a pair of spaced apart parallel support portions joined at one end by a contacting portion substantially perpendicular to the support portions, and the contacting portion contacts the lock. In this embodiment, the support portions may be coupled to the handle.

According to another feature of the present invention, the lock further includes a projection, and the blade further includes a locking recess. In this knife, when the blade is in a fully open position the projection is disposed within the locking recess.

Additionally, the invention is a knife comprising a handle with a first end and a second end, a blade pivotally coupled to the handle near the first end, a lock pivotally coupled to the handle, and a spring. The spring includes at least one longitudinally extending support portion and at least one transversely extending contacting portion. The support portion is coupled to the handle and the contacting portion contacts the lock.

According to one feature of the present invention, the spring is formed of a single piece of material.

Furthermore, the invention is a knife comprising a handle with a first end and a second end, a blade pivotally coupled to the handle near the first end, a lock pivotally coupled to the handle, and a spring. The handle further includes a recess near the first end and the spring is located in the recess coupling the spring to the handle. The spring extends rearward toward the second end.

In such a knife, the handle may further include a pair of recesses and a pair of support portions of the spring can be is located in the pair of recesses.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 3:
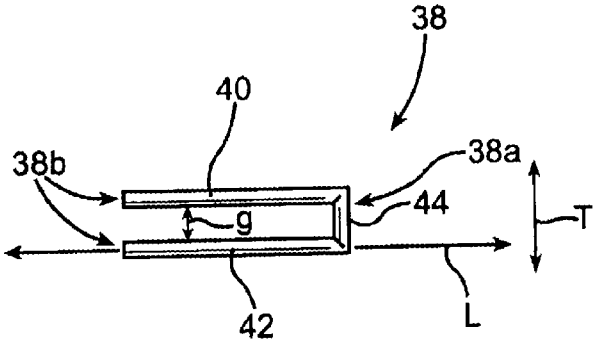
FIG. 3 is a top view of the spring of FIG. 2, the bottom view being a mirror image.
Figure 2:
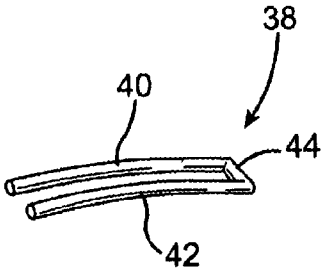
FIG. 2 is a perspective view of the spring of FIG. 1.
Figure 1:
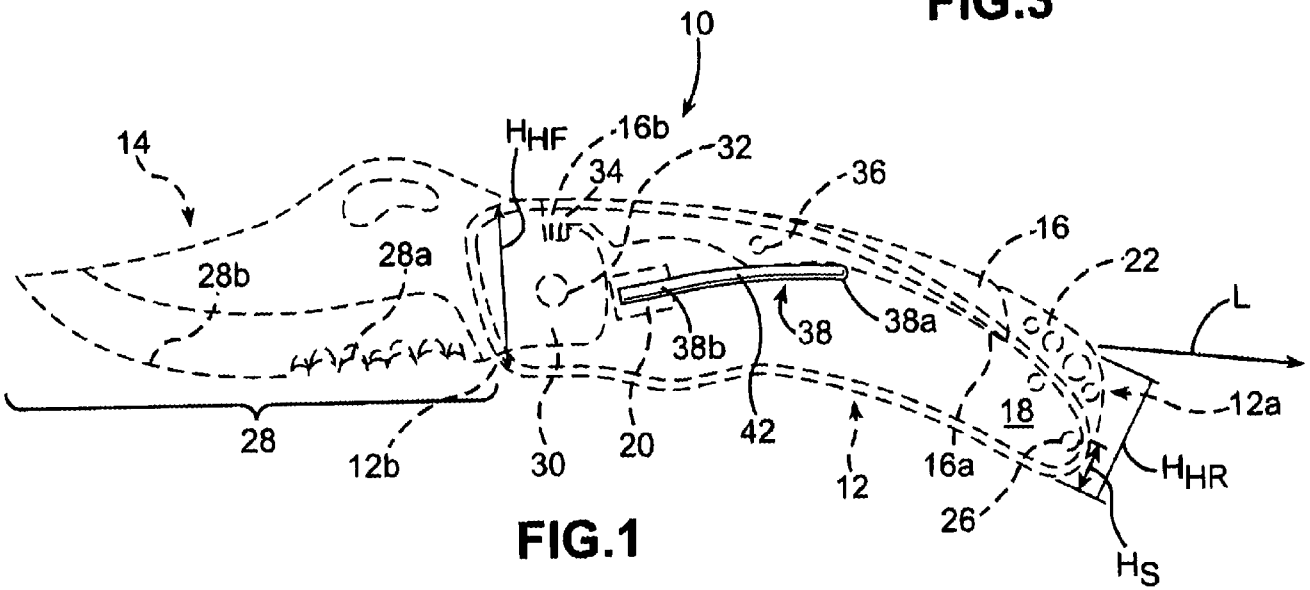
FIG. 1 is a front view of a spring of the present invention within a knife of the present invention, the rear view being a mirror image, and the components of the knife other than the spring are shown in phantom.

Referring now to the drawings, wherein like reference numerals represent identical or corresponding parts throughout the several views, and more particularly to FIGS. 1–3 thereof, a knife of the present invention is indicated generally by reference numeral 10.

Referring to FIG. 1, knife 10 generally comprises a handle 12, a blade 14, and a lock 16. The handle 12 includes a pair of side panels. One side panel 18 is shown in FIG. 1, and the other being a mirror image thereof. Each side panel 18 includes a retention recess 20.

The handle 12 further includes a first or rear end 12*a*, a second or front end 12*b*, and a spacer 22 at the rear end 12*a*. The spacer 22 separates the side panels 18 to form an interior cavity therebetween. The side panels 18 and spacer 22 can be held together with fasteners 26.

As is customary in folding knives, blade 14 is an integral structure with a working portion 28 and a tang 30. The working portion 28, in this embodiment, includes both a serrated cutting section 28*a* and a non-serrated or straight cutting section 28*b*. The blade 14 is pivotally coupled to the front end 12*b* of handle 12 using conventional techniques known by those of ordinary skill in the art via pivot pin 32 through tang 30. Tang 30 includes a locking recess 34 in its upper edge. The knife 10 is shown with the blade 14 in a fully open position, however, as in conventional knives the blade 14 is movable between a closed position and the open position.

The lock 16 is pivotally coupled to the handle 12 using conventional techniques known by those of ordinary skill in the art via pivot pin 36. The lock 16 includes a distal end 16*a* and a proximate end 16*b*. The proximate end 16*b* is formed into a locking projection that cooperates with the locking recess 34 when the blade 14 is in the fully open position.

With reference to FIGS. 1–3, the knife 10 further includes a spring 38 with a free end 38*a* and supported ends 38*b*. The spring 38 is formed of a single piece of material bent to form two spaced apart substantially parallel support portions 40, 42 joined at the free end 38*a* by a contacting portion 44. A gap g is defined between the support portions 40, 42. The support portions 40, 42 extend generally longitudinally along longitudinal axis L that extends from the front to the rear of the knife and the contacting portion 44 extends generally transversely between side panels 18 along a transverse axis T. As a result, the spring 38 has a generally U-shape, as shown in FIG. 2. In this embodiment, the contacting portion 44 is substantially perpendicular to the support portions 40, 42 and the bend therebetween is sharp.

Referring to FIG. 1, a segment of the support portions 40, 42 are located in the retention recesses 20 in the handle 12 so that the spring 38 is coupled to the handle 12 at the supported ends 38*b*. The spring 38 and handle are configured and dimensioned so that the contacting portion 44 of the spring 38 contacts the lock 16. In the open position, as shown in FIG. 1, the spring 38 biases the distal end 16*a* of the lock upward to aid in positioning locking projection 16*b* within locking recess 34.

In a preferred embodiment, as shown in FIG. 2, the segments of the spring 38 are generally cylindrical so that it has a circular cross-sectional shape. Also in a preferred embodiment, the spring 38 is coupled to the handle 12 near the first end 12*b* of the handle and the spring 38 extends rearward toward the rear end 12*a*.

In this embodiment, a front handle height is designated $H_{HF}$, a rear handle height is designated $H_{HR}$, and a side panel height at the rear is designated $H_s$. In this embodiment, the front handle height $H_{HF}$ is greater than the rear handle height $H_{HR}$ SO that the handle narrows toward the rear. Additionally, the side panel height $H_s$ is less than the rear handle height $H_{HR}$. The ability to shape the handle in this manner is due to the spring 38 being located near the front end 12*b* of the handle 12.

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims. Therefore, this invention is not to be limited to the specifically preferred embodiment depicted therein. The invention is a knife with a spring having a transversely extending portion that contacts a lock. Thus, the details of these components as set forth in the above-described preferred embodiment, should not limit the scope of the present invention.

Further, the purpose of the Abstract is to enable the U. S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

Appendix

Attached hereto and submitted herewith as a part of this application are thirteen photographs labeled FIGS. A–E that show a product that incorporates the claimed subject matter and the product in use. Upon allowance of this application, this appendix may be deleted, to remain a part of the file, and need not be printed as part of any patent that may issue.

We claim as our invention:

1. A knife comprising:

a handle;

a blade pivotally coupled to said handle;

a lock pivotally coupled to said handle; and a spring coupled to said handle and contacting said lock, said spring further including a pair of spaced apart support portions joined by a transversely extending contacting portion such that said spring has a U-shape and a transversely extending gap between said support portions.

2. The knife of claim 1, wherein said handle further includes a first end and a second end, and said blade is coupled to said handle near said first end.

3. A knife comprising:

a handle including a first end and a second end;

a blade pivotally coupled to said handle near said first end;

a lock pivotally coupled to said handle; and a U-shaped spring coupled to said handle and contacting said lock, said spring further includes supported ends near said first end of said handle.

4. The knife of claim 1, wherein said spring further includes a circular cross-sectional shape.

5. The knife of claim 1, wherein said support portions are parallel and said contacting portion is substantially perpendicular to said support portions, and said contacting portion contacts said lock.

6. The knife of claim 5, wherein said support portions are coupled to said handle.

7. The knife of claim 1, wherein said lock further includes a projection, and said blade further includes a locking recess, wherein when said blade is in a fully open position said projection is disposed within said locking recess.

8. The knife of claim 2, wherein said handle further defines a first height at said first end and a second height at said second end, said second height being less than said first height.

9. A knife comprising:

a handle having a first end and a second end;

a blade pivotally coupled to said handle near said first end;

a lock pivotally coupled to said handle; and a spring including at least one longitudinally extending support portion and at least one transversely extending contacting portion, said contacting portion being substantially perpendicular to each support portion, said support portion being coupled to said handle and said contacting portion contacting said lock on a lower surface thereof.

10. The knife of claim 9, wherein said spring further includes a pair of spaced apart support portions joined by said contacting portion such that said spring has a U-shape.

11. The knife of claim 10, wherein said support portions are coupled to said handle near said first end adjacent said blade.

12. The knife of claim 9, wherein said spring is formed of a single piece of material.

13. A knife comprising:

a handle having a first end and a second end, said handle further including a recess near said first end of said handle;

blade pivotally coupled near said first end of said handle, said blade including a tang;

a lock pivotally coupled to said handle; and a spring located in said recess such that said spring is coupled to said handle near said tang, and said spring extending rearward toward said second end.

14. The knife of claim 13, wherein said spring has a pair of spaced apart parallel support portions joined at one end by a contacting portion substantially perpendicular to said parallel portions.

15. The knife of claim 14, wherein said handle further includes a pair of recesses and said pair of support portions is located in said pair of recesses.

16. The knife of claim 14, wherein said contacting portion contacts said lock.

17. The knife of claim 13, wherein said handle further includes two side panels separated by a spacer, said spacer being joined to said side panels by fasteners.

* * * * *